United States Patent [19]

Lomax

[11] 4,015,225

[45] Mar. 29, 1977

[54] ENCAPSULATED ELECTROMECHANICAL RELAY

[75] Inventor: Ronald W. Lomax, London, England

[73] Assignee: International Standard Electric Corporation, New York, N.Y.

[22] Filed: Nov. 20, 1974

[21] Appl. No.: 525,605

[30] Foreign Application Priority Data

Dec. 20, 1973 United Kingdom ..... 59169/73

[52] U.S. Cl. ..... 335/133; 335/154; 335/196

[51] Int. Cl.[2] ..... H01H 63/02

[58] Field of Search ..... 335/196, 154, 83, 97, 335/133, 106

[56] References Cited

UNITED STATES PATENTS

| | | | |
|---|---|---|---|
| 3,324,432 | 6/1967 | Ridler et al. | 335/154 X |
| 3,575,678 | 4/1971 | Barton | 335/151 |
| 3,626,337 | 12/1971 | Woodhead | 335/196 |
| 3,629,749 | 12/1971 | Woodhead | 335/196 |

*Primary Examiner*—George Harris
*Attorney, Agent, or Firm*—John T. O'Halloran; Thomas M. Marshall; Peter C. Van Der Sluys

[57] ABSTRACT

An encapsulated electromechanical relay provides both make and break contact functions by utilizing a movable diaphragm for connecting between inner and outer concentric conductors. In a non-energized state the diaphragm provides electrical continuity between one pair of contact members, and in a magnetically energized state the movable diaphragm contact then povides electrical continuity between a second pair of contact members by moving away from the central contact of the first pair and moving into contact with the central contact of the second pair.

11 Claims, 7 Drawing Figures

ENCAPSULATED ELECTROMECHANICAL RELAY

FIELD OF THE INVENTION

This invention relates to electromechanical relays.

BACKGROUND OF THE INVENTION

The inventive relay contains many of the features described in the following U.S. patents issued to H. S. Woodhead and assigned to the assignee of the instant invention. U.S. Pat. Nos. 3,331,040; 3,467,923; 3,470,505; 3,626,337; and 3,629,749. The aforementioned U.S. patents are incorporated herein by reference to provide background description of the prior art of relays in general and in particular to the state of the relay art over which this invention provides advancement.

SUMMARY OF THE INVENTION

According to the present invention there is provided an electromechanical relay embedded in encapsulation so that the contact and winding terminal connections of the relay protrude from the encapsulation arranged in dual-in-line configuration. The relay includes at least one contact unit having a fixed contact provided by an inner ferromagnetic member sealed through an aperture in an outer ferromagnetic member to which the periphery of a ferromagnetic diaphragm is attached. The diaphragm forms the movable contact of the contact unit and is normally spaced from the fixed contact with which it is urged into electrical contact by the energization of a relay winding which produces a magnetic field between said inner and outer ferromagnetic members.

DESCRIPTION OF THE PREFERRED EMBODIMENT

Figure 1:
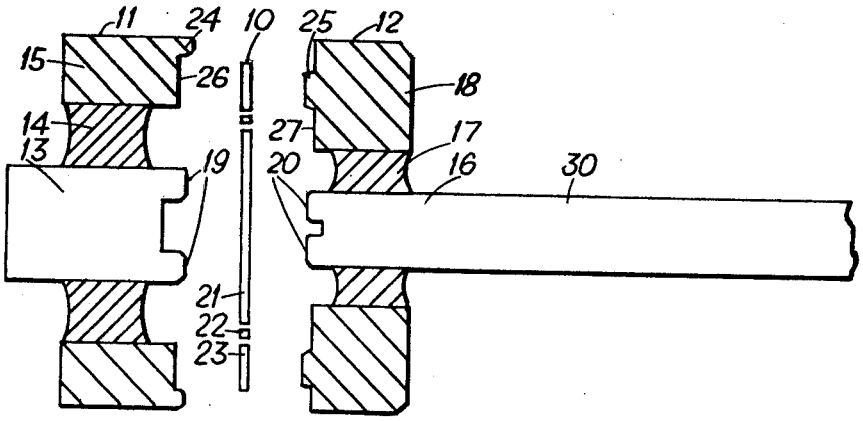
FIG. 1 is an exploded view of an axial section of the contact unit assembly of the relay of this invention.

The contact unit of the inventive relay is a hermetically sealed unit, and consists essentially of a ferromagnetic diaphragm 10 sandwiched between a break contact assembly 11 and a make contact assembly 12 as shown in FIG. 1. The break contact assembly consists of a ferromagnetic rod 13 secured by a glass-to-metal seal 14 centrally through the bore of a ferromagnetic annulus 15. Similarly the make contact assembly consists of a ferromagnetic rod 16 secured by a glass-to-metal seal 17 centrally through the bore of a ferromagnetic annulus 18. The inner ends of the two rods 13 and 16 are bored to provide annular contact making surfaces 19 and 20 respectively.

Figure 2:
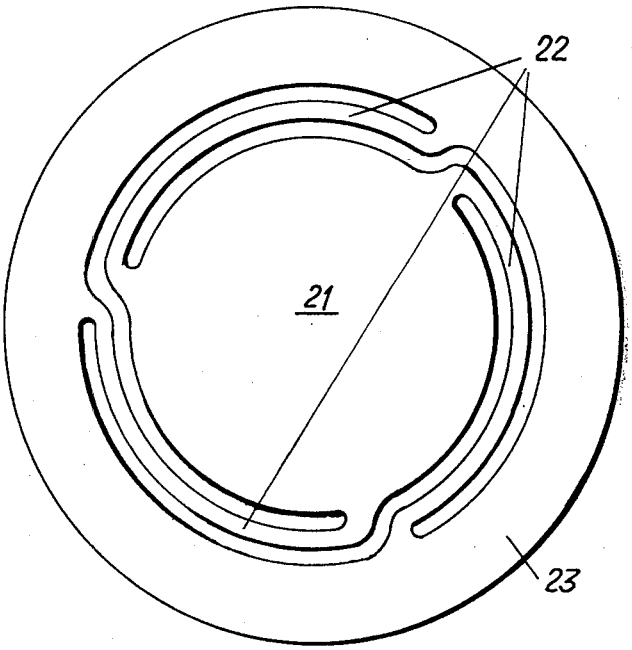
FIG. 2 is a plan view of the diaphragm of the contact unit of FIG. 1.

Referring now to FIG. 2, the diaphragm, which in its unstressed condition is flat, consists of a central region 21 linked by three slender arcuate tongues 22 to a peripheral region 23. The diaphragm, and also the contact making surfaces 19 and 20 of both rods 13, 16 as well as all other contact making surfaces, including elements 24–26, are plated with hard gold or other precious metal to provide good contact making properties.

Annulus 15 of the break contact assembly shown in FIG. 1 is provided with a projection welding ring 24 which fits around an annular ridge 25 formed on annulus 18 of the make contact assembly. The diaphragm 10 fits inside the welding ring 24 so that its peripheral region 23 is compressed between the ridge 25 and the main face 26 of the break contact annulus by the welding operation. The contact making surface 19 extends above surface 26 so that when the contact unit is unenergized the resilience of the diaphragm causes its central region to be held in contact with the break contact. The contact making surface 20 is recessed with respect to the ridge 25 but extends above the main face 27 of the make contact annulus. In this way the diaphragm is normally spaced from the make contact while the inner part of the face 27 is dimensioned to prevent the occurrence of make before break action. The inner part of the face 27 also provides a flux return path when the contact unit is energized.

In the break contact assembly the rod extends a short distance beyond the annulus sufficient to facilitate the making of a terminal connection to the rod. In the make contact assembly the rod extends a considerable distance beyond the annulus in order to provide the core 30 of a relay winding 31 wound upon a bobbin 32. A U-shaped yoke 33 of ferromagnetic material fitted over the winding and bobbin completes the magnetic circuit.

Figure 3:
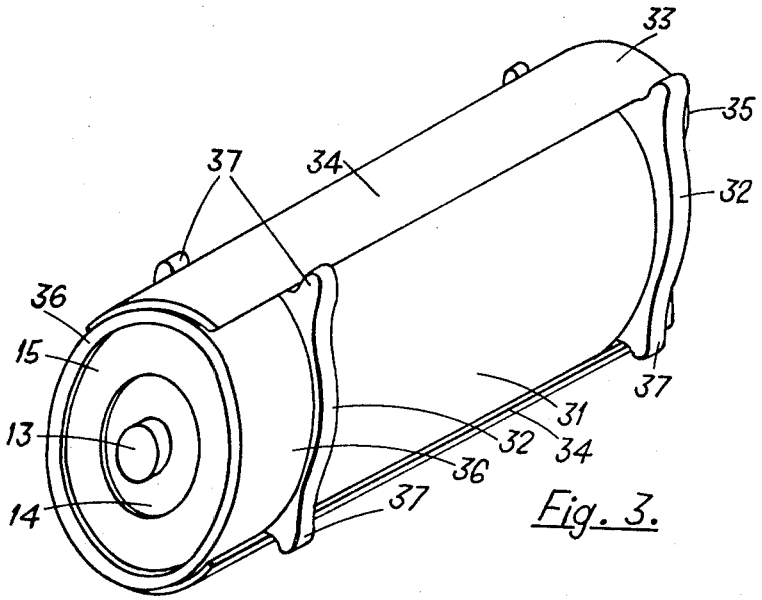
FIG. 3 is a perspective view of the contact unit of FIG. 1 together with its bobbin, winding and yoke.

When the relay is energized the majority of the magnetic flux entering the central region of the diaphragm via the make contact leaves the diaphragm via the face of the make contact annulus. This flux is divided between the two limbs 34 of the yoke as shown in FIG. 3, and returns to the core by way of the end plate 35 of the yoke which is fitted over the end of the core. A short length of heat shrinkable insulating tubing 36 is shrunk over the curved surface of the contact unit in order to prevent the yoke from establishing a short circuit between the make contact (the rod 16) and the common contact (the diaphragm 10). The bobbin checks are provided with lugs 37 to prevent rotation of the bobbin with respect to the yoke. Rotation of the contact unit with respect to the yoke may optionally be prevented either by crimping the yoke to the core where the latter protrudes through the yoke end plate 35, or alternatively by making a weld at this point.

The assembly of contact unit, bobbin, winding, and yoke is lowered into a cradle formed by the inner ends of the leads of a lead frame. The lead frame, which may be blanked from nickel silver or may be tin lead solder plated mild steel fashioned by photoetching, consists essentially of a frame 38 having fourteen inwardly directed leads 39 to 52. The winding around which is wrapped a sheet of protective insulation rests on leads 41, 42, 43, 44, 48, 49 and 50 to which no electrical connection is made. Electrical connections are shown diagrammatically in FIG. 4. Connection with the winding 31 is made by welding the ends of the winding to leads 40 and 47. Optionally leads 40 and 51 are commoned by a flying lead. The end leads are bent up out of the plane of the frame and embrace the ends of the assembly. The end leads may not be bent up if flat leads can be accommodated. A strip 53 linking leads 45 and 46 is welded to the end of the core, while the inner ends of leads 39 and 52 are welded respectively to the annulus 15 and the end face of rod 13.

Figure 4:
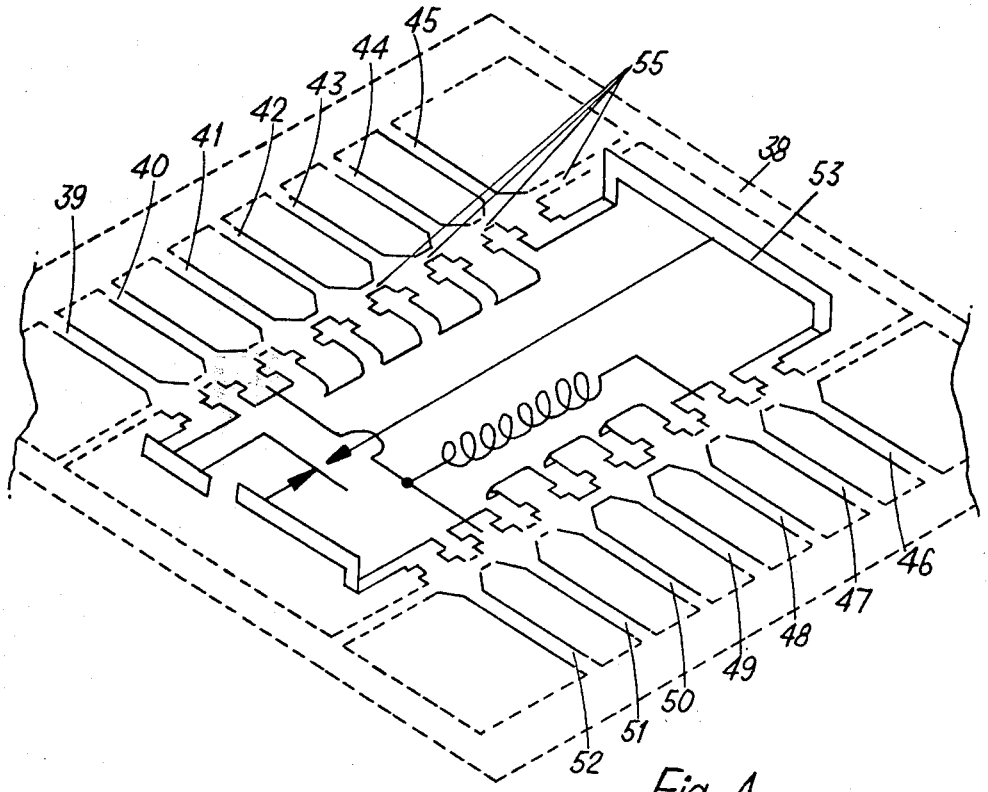
FIG. 4 is a lead frame to which the assembly of FIG. 3 is to be attached, and shows diagrammatically the arrangement of terminal connections.
Figure 5:
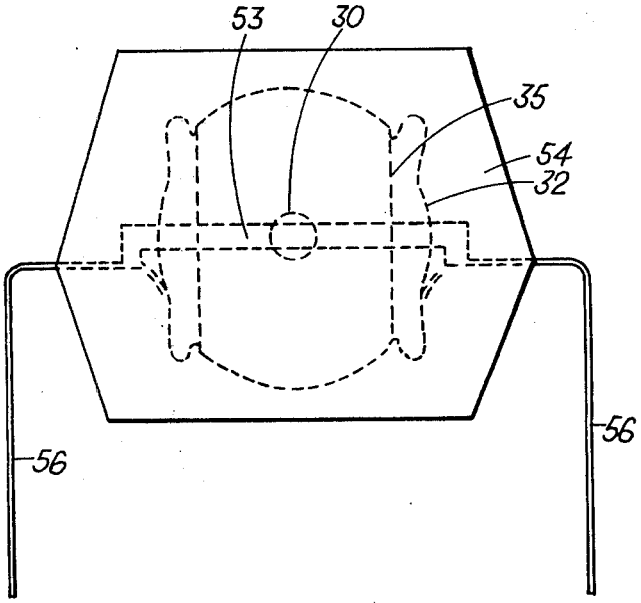
FIG. 5 dipicts the completed encapsulated inventive relay assembly viewed from the end opposite the contact unit.

Next the assembly is encapsulated in plastics material by transfer molding. Typically the encapsulation 54, shown in FIG. 5, is a loaded epoxy resin. Initially the inner ends of the leads are strengthened by webs 55, but after the molding operation at least those of the webs shown in broken outline are cropped away together with the frame 38 as shown in FIG. 4. The webs also serve to dam the flow of encapsulant and thereby simplify the design of the molds used in the encapsulating process. Finally the outer ends of the leads are bent down to provide the conventional dual-in-line arrangement of terminals 56.

Figure 7:
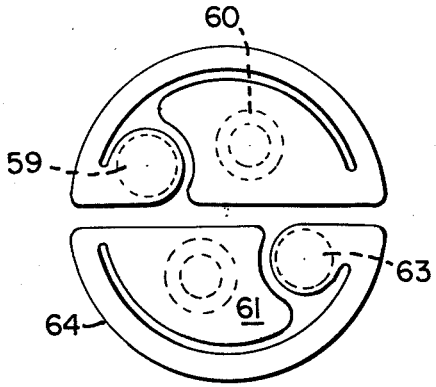
FIG. 7 depicts the arrangement and configuration of laminae for the device illustrated in FIG. 6.
Figure 6:
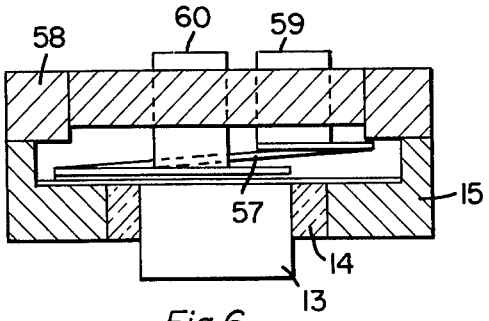
FIG. 6 depicts another contact unit which is a two-pole ON/OFF contact unit.

While the above description has related specifically to a single changeover contact operation type of relay it should be apparent that other contact arrangements are possible. Thus the above described construction may be modified by the replacement of the break contact assembly with a simple cover to provide a contact unit similar to that described in aforementioned U.S. Pat. No. 3,331,040. Another modification involves having a contact unit, either single make or single changeover, at each end of the winding. A magnetically holding version of any of the above types of relay may also be constructed by the incorporation of a permanent magnet into the magnetic circuitry of the relay. A single contact unit version would have features in common with the relay described in aforementioned U.S. Pat. No. 3,470,505 while a double contact unit version would have features in common with certain of the relays described in aforementioned U.S. Pat. No. 3,626,337. A double contact unit version is illustrated in FIGS. 6 and 7. Two resilient laminae 57 are substituted for the diaphragm 10 and there are four terminals sealed through the central aperture of an outer cap member 58. Two of these terminals are anchorage posts 59, to which the laminae are secured and the remaining two are fixed contact members 60, each provided with a precious metal fixed contact surface which is annular and which butts against the contact making region 61 of the lamina 57 slightly distorting it from the flat in order to provide the necessary contact pressure. The involute shape of the laminae is shown in FIG. 7, each lamina consisting of a contact making area 61 linked to an anchorage area 63 by a single arm 64 which embraces the side of the laminae. FIG. 7 also shows in dotted detail the position of the anchorage post 59 and the annular contact making surfaces of the contacts 60 in their relation to the laminae. Since the laminae are substituted for the diaphram they must also be made of magnetic material and may also be plated to improve their conductivity and contact properties. External electrical connections to this contact unit are made to the two anchorage posts 59 and the two fixed contact members 60.

It is to be understood that the foregoing description of specific examples of this invention is made by way of example only and is not to be considered as a limitation on its scope.

What is claimed is:

1. An encapsulated electromechanical relay having contact and winding terminals extending from the encapsulation for dual-in-line configurations comprising:

a first contact unit having a fixed contact provided by an inner ferromagnetic member and an outer ferromagnetic member, said inner member sealed through an aperture in said outer member;

a ferromagnetic diaphragm movably attached to said outer member at the periphery of said diaphragm, said diaphragm providing a movable contact; and a relay winding proximate said diaphragm for providing magnetic attraction to said diaphragm, said diaphragm being positioned apart from said inner member when said relay is non-energized and said diaphragm becoming magnetically attracted into contact with said inner member when said relay is energized.

2. The relay of claim 1 wherein said diaphragm comprises a central region and a peripheral region with a plurality of arcuate tongues intermediate said central and peripheral regions.

3. The relay of claim 1 further including a second contact unit comprising a second inner contact member sealed through an aperture of a second outer member, said first and second units located on opposite sides of said diaphragm.

4. The relay of claim 3 wherein said first and second contact units provide a changeover contact function whereby said diaphragm electrically connects between said first inner and outer members when said relay is non-energized and whereby said diaphragm becomes magnetically attracted to said second inner contact member for providing electrical continuity therebetween said second inner and outer members when said relay is energized.

5. The relay of claim 1 wherein said inner and outer contact members are provided with a precious metal coating on at least part of their surface.

6. The relay of claim 1 wherein said fixed contact member further comprises an annular contact making surface.

7. The relay claim 1 wherein said contact unit is hermetically sealed.

8. The relay of claim 1 wherein said terminals are provided by a plurality of inwardly directed leads extending from a lead frame.

9. In an electromechanical relay having at least one contact unit and a moveable ferromagnetic diaphragm operably associated with a relay winding to cause said diaphragm to make and break electrical contact, the improvement which comprises:

said contact unit having a fixed contact provided by an inner ferromagnetic member and an outer ferromagnetic member, with said inner member being positioned in and sealed to said outer member through an aperture in said outer member;

said ferromagnetic diaphragm being attached at its periphery to said outer member;

said relay winding being positioned proximate to said diaphragm for providing magnetic attraction to said diaphragm, said diaphragm being positioned in a spaced relationship to said inner member when said relay is non-energized and said diaphragm becoming magnetically attracted into contact with said inner member when said relay is energized;

a lead frame having contact and winding terminals formed thereon electrically connected to said inner and outer members and to said relay winding, said lead frame being formed in a dual-in-line configuration; and said contact unit, said diaphragm, said relay winding, and said lead frame being encapsulated with said terminals extending to the exterior of said encapsulation and formed into a dual-in-time configuration.

10. The relay of claim 9 further including a second contact unit comprising a second inner contact member positioned within and sealed to a second outer member through an aperture in said second outer member, said first and second units being positioned on opposite sides of said diaphragm.

11. The relay of claim 10 wherein said first and second contact units form a changeover contact wherein said diaphragm electrically connects between said first inner and outer members when said relay is non-energized and wherein when said winding is energized said diaphragm is magnetically attracted to said second inner contact member for providing electrical continuity between said second inner member and said outer members thereby to perform a make function when said winding is non-energized and a break function when said relay is energized.

* * * * *